US008087597B2

(12) United States Patent
Cheng

(10) Patent No.: US 8,087,597 B2
(45) Date of Patent: Jan. 3, 2012

(54) SPRAY GUN STRUCTURE

(75) Inventor: Chi Han Cheng, Changhua Hsien (TW)

(73) Assignee: Yuan Mei Corp., Changhua County (TW)

( * ) Notice: Subject to any disclaimer, the term of this patent is extended or adjusted under 35 U.S.C. 154(b) by 0 days.

(21) Appl. No.: 12/081,112

(22) Filed: Apr. 10, 2008

(65) Prior Publication Data

US 2011/0220738 A1 Sep. 15, 2011

(51) Int. Cl.
*B05B 7/02* (2006.01)

(52) U.S. Cl. ..... 239/526; 239/525

(58) Field of Classification Search ..... 239/525, 239/523, 548, 558, 569, 600
See application file for complete search history.

(56) References Cited

U.S. PATENT DOCUMENTS 4,776,517 A * 10/1988 Heren ..... 239/391
5,323,968 A * 6/1994 Kingston et al. ..... 239/449
6,260,772 B1 * 7/2001 Hennemann et al. ..... 239/310
7,080,795 B2 * 7/2006 Chen ..... 239/394
7,226,002 B2 * 6/2007 Luo ..... 239/526
7,533,833 B2 * 5/2009 Wang et al. ..... 239/526

* cited by examiner

*Primary Examiner* — Davis Hwu
(74) *Attorney, Agent, or Firm* — Chi IP Law Firm

(57) ABSTRACT

A spray gun structure comprises a control valve mounted into an assembling chamber of a body and regulated by an adjusting device to control the on/off of water discharge thereby. A coupling sleeve is joined to the body with an abutment surface of a water-sealing sleeve abutting tight against a water-sealing area of the control valve, and protruding tracks engaged with guide recesses of a water-guiding element. A spray head having a connecting sleeve and a restrain collar mounted thereto is fitted to the body and screw-joined to the water-sealing element. The connecting sleeve is mounted to abut against the coupling sleeve, and the restrain collar has restrain blocks to restrict protrusions of the body. Therefore, when the spray head is pivotally rotated to and forth in its place, the water-guiding element can be synchronically actuated to move linearly forwards or backwards to verify the pattern of water spray thereby.

15 Claims, 13 Drawing Sheets

SPRAY GUN STRUCTURE

BACKGROUND OF THE INVENTION

The present invention relates to a spray gun structure wherein an adjusting device is utilized to actuate a control valve equipped with a water-sealing area and a water-influx area so as to control the on/off of water discharge and achieve micro-adjustment of water volume thereby; besides, a connecting sleeve is mounted to press against a coupling sleeve, permitting an abutment surface of a water-sealing sleeve to seal tight onto the water-sealing area of the control valve to ensure leak-proof purpose in a water shutoff state, and the water-sealing area of the control valve can also rotate along the arcuate surface of the abutment surface of the water-sealing sleeve so that the adjusting device can smoothly actuate the control valve to open or close the water discharge, achieving effortless operation thereby.

Conventionally, a spray gun for gardening utilizes a pressurized-handle design wherein the handle is pressed for the sprinkling of water, and the force exerting onto the handle determines the water volume discharged, which is quite uncomfortable and can cause pains in the hands in case the handle is gripped for a long time or for the distribution of water to a large area. Besides, it's difficult to accurately control the force exerting onto the handle thereof, and the water discharge tends to emit outwards in inconstant volume, which is very inconvenient in application.

Furthermore, some conventional spray guns are characterized by the application of numerous assembling parts, which can boost the cost of production and material as well as waste time in assembly.

SUMMARY OF THE PRESENT INVENTION

It is, therefore, the primary purpose of the present invention to provide a spray gun structure wherein an adjusting device is utilized to actuate the movement of a control valve equipped with a water-sealing area and a water-influx area to achieve water-discharge and water shutoff design and allow micro-adjustment of water volume discharged in application thereby.

It is, therefore, the second purpose of the present invention to provide a spray gun structure wherein a water-guiding element is equipped with guide recesses to join to protruding tracks of a coupling sleeve mounted into a body; a connecting sleeve has one end fixedly joined to a spray head so as to restrict the position of a restrain collar, and the other end mounted to a connecting section of the body thereof; whereby, when the spray head is pivotally rotated to and forth in its place, the water-guiding element is synchronically actuated to move linearly forwards or backwards so as to verify the pattern of water spray thereby, permitting the spray gun to form a hidden-type adjustment of the spray patterns thereby.

It is, therefore, the third purpose of the present invention to provide a spray gun structure wherein the coupling sleeve is pressed by the connecting sleeve, permitting an abutment surface of a water-sealing sleeve to seal tight onto the water-sealing area of the control valve, and a water-sealing portion of the control valve thereof to abut tight against the internal surface of a conjoining hole of the body, providing dual water-sealing design to ensure accurate leaking-proof purpose in a water shutoff state thereby; besides, the water-sealing area of the control valve can also rotate along the arcuate surface of the abutment surface of the water-sealing sleeve so that the adjusting device can smoothly actuate the movement of the control valve to open or close the water discharge, achieving effortless operation thereby.

DETAILED DESCRIPTION OF THE PREFERRED EMBODIMENTS

Figure 1:
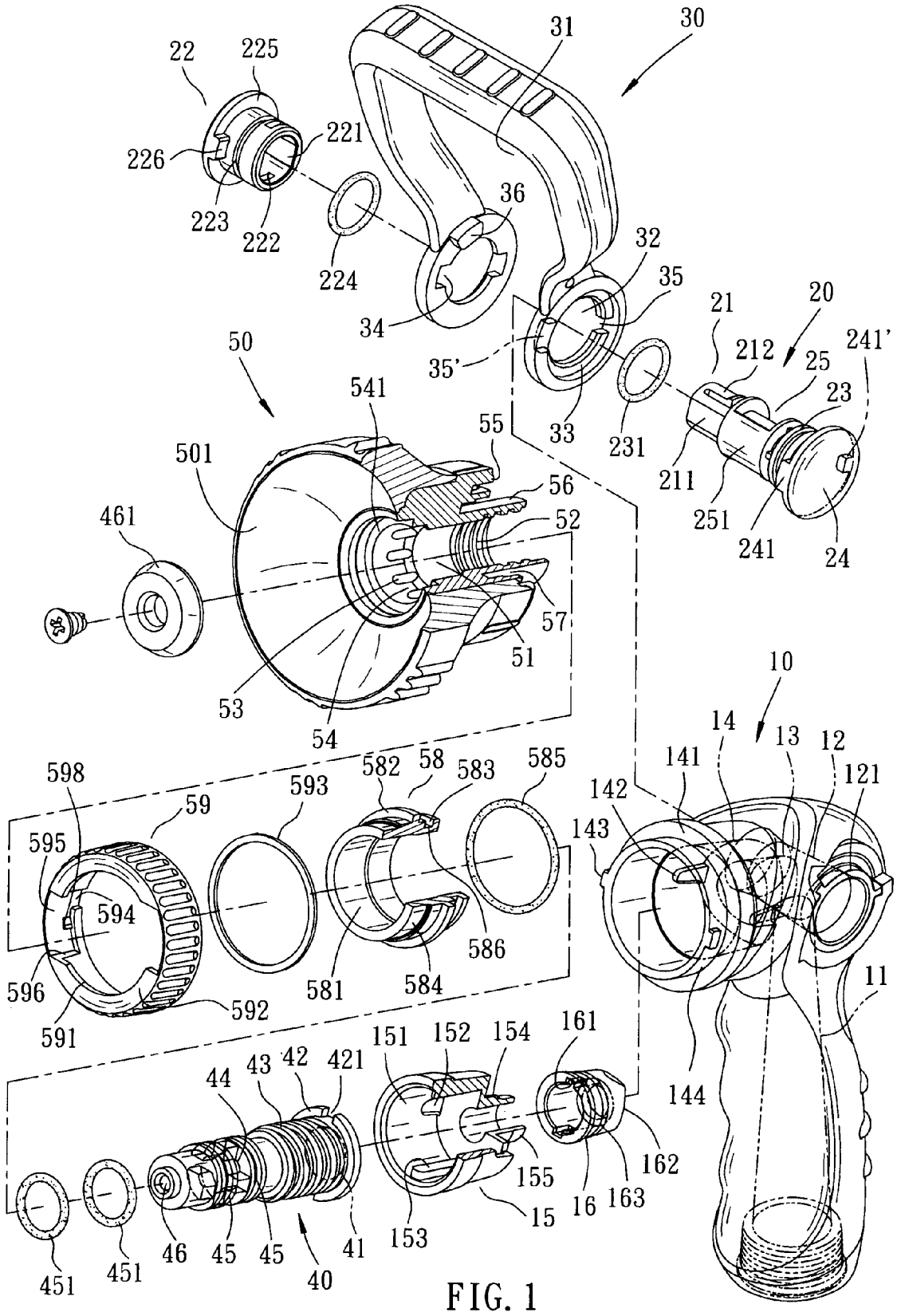
FIG. 1 is an exploded perspective view of the present invention.
Figure 2:
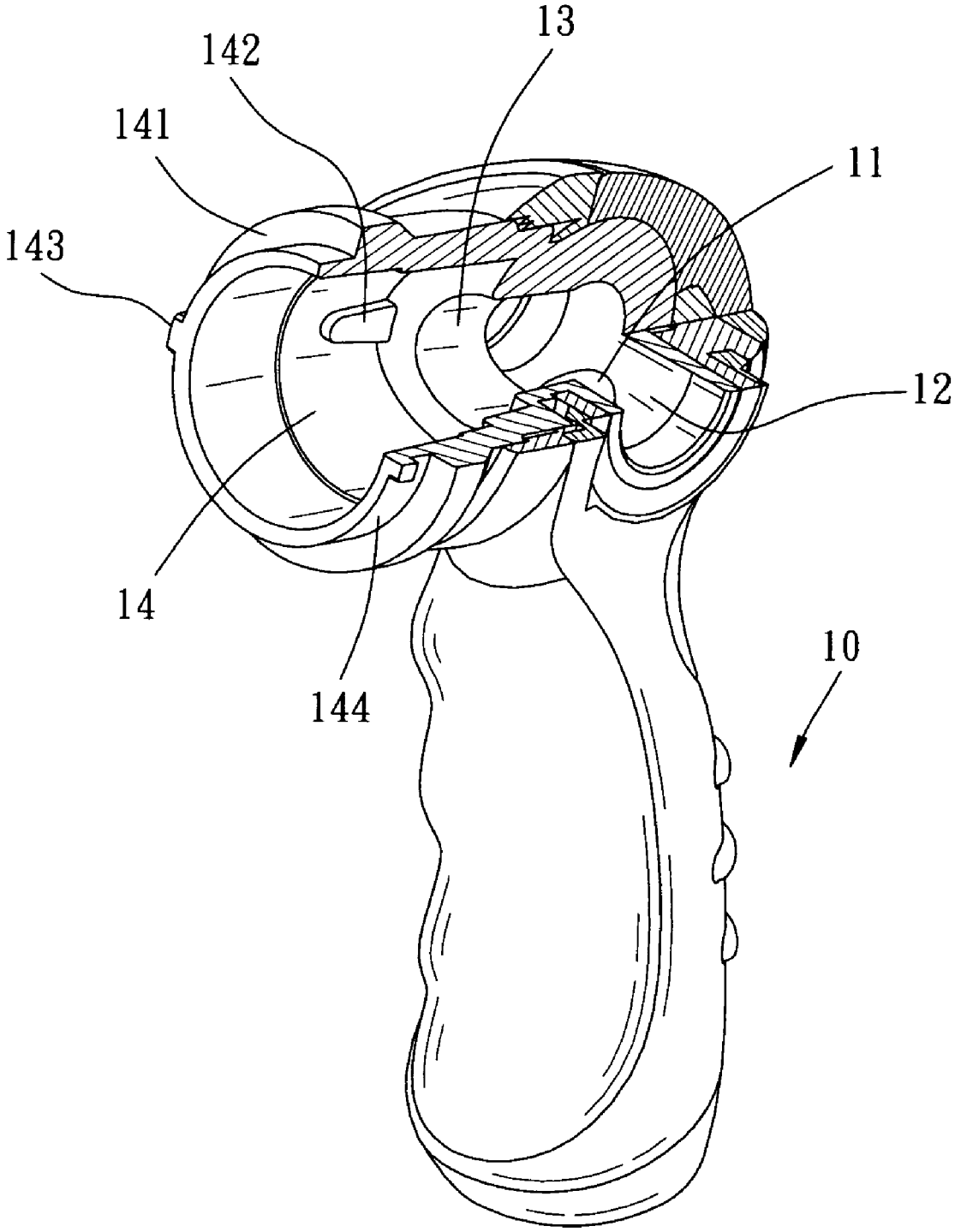
FIG. 2 is a partially cross sectional view of a body of the present invention.
Figure 3:
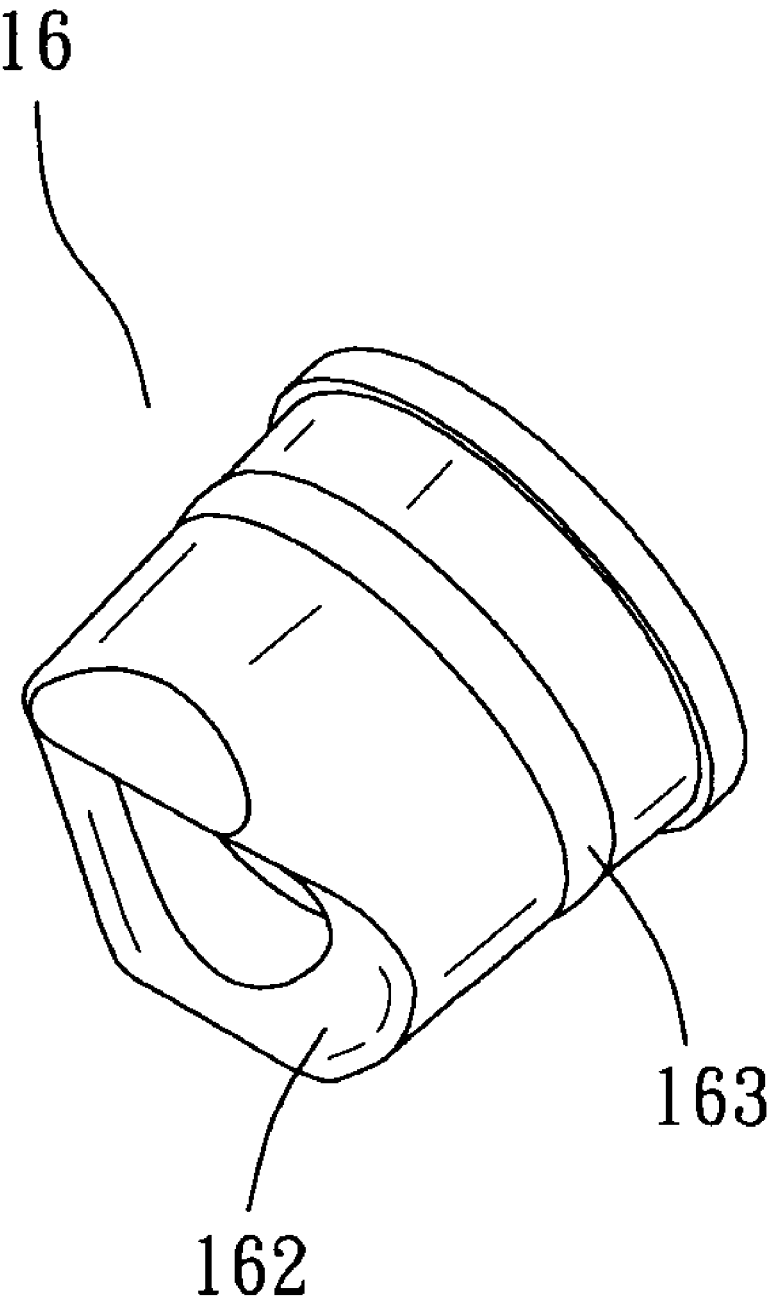
FIG. 3 is an enlarged perspective view of a water-sealing sleeve of the present invention.
Figure 4:
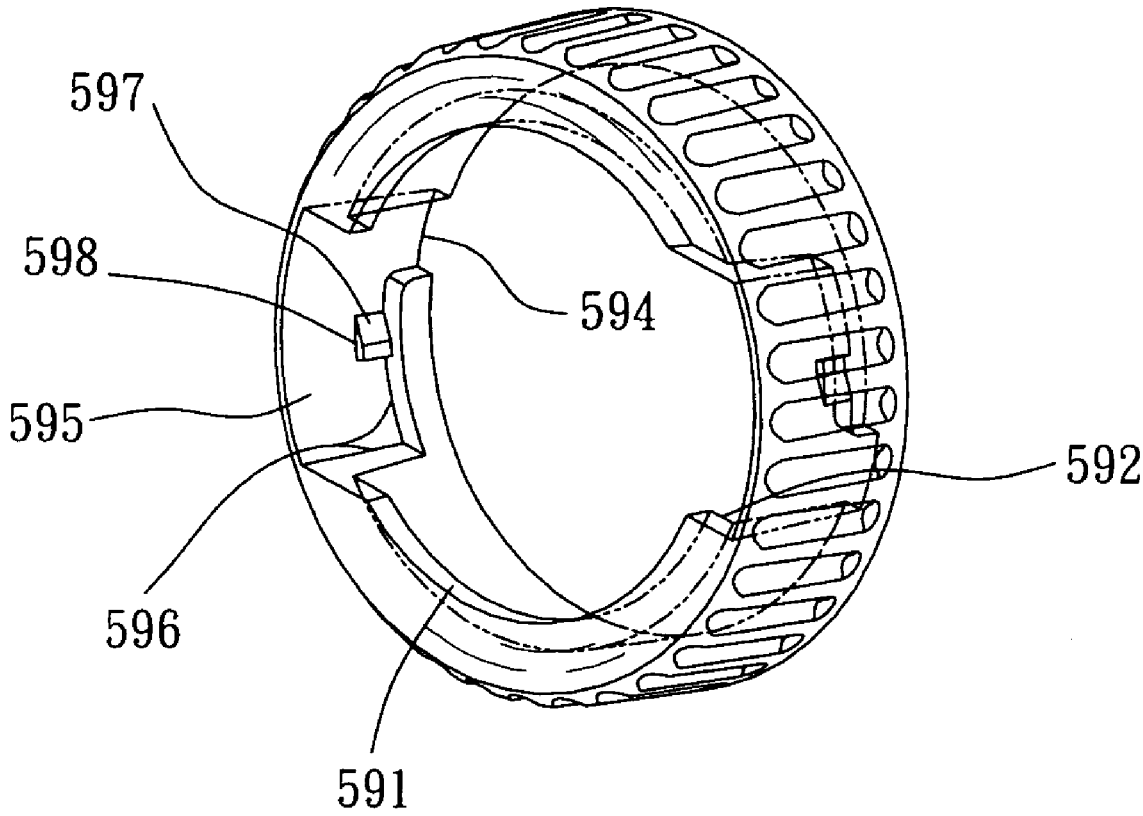
FIG. 4 is an enlarged perspective view of a restrain collar of the present invention.
Figure 5:
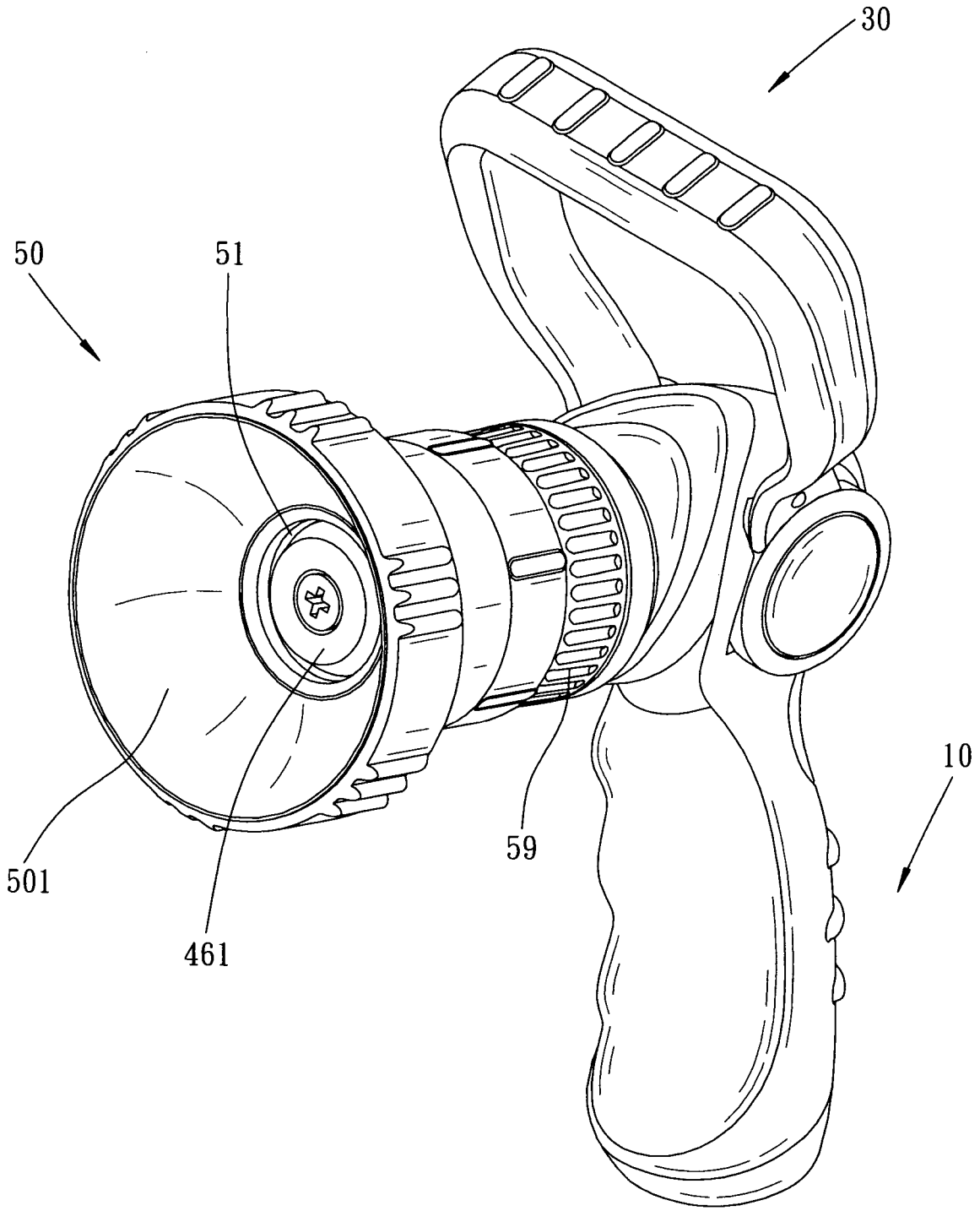
FIG. 5 is an assembled perspective view of the present invention.
Figure 6:
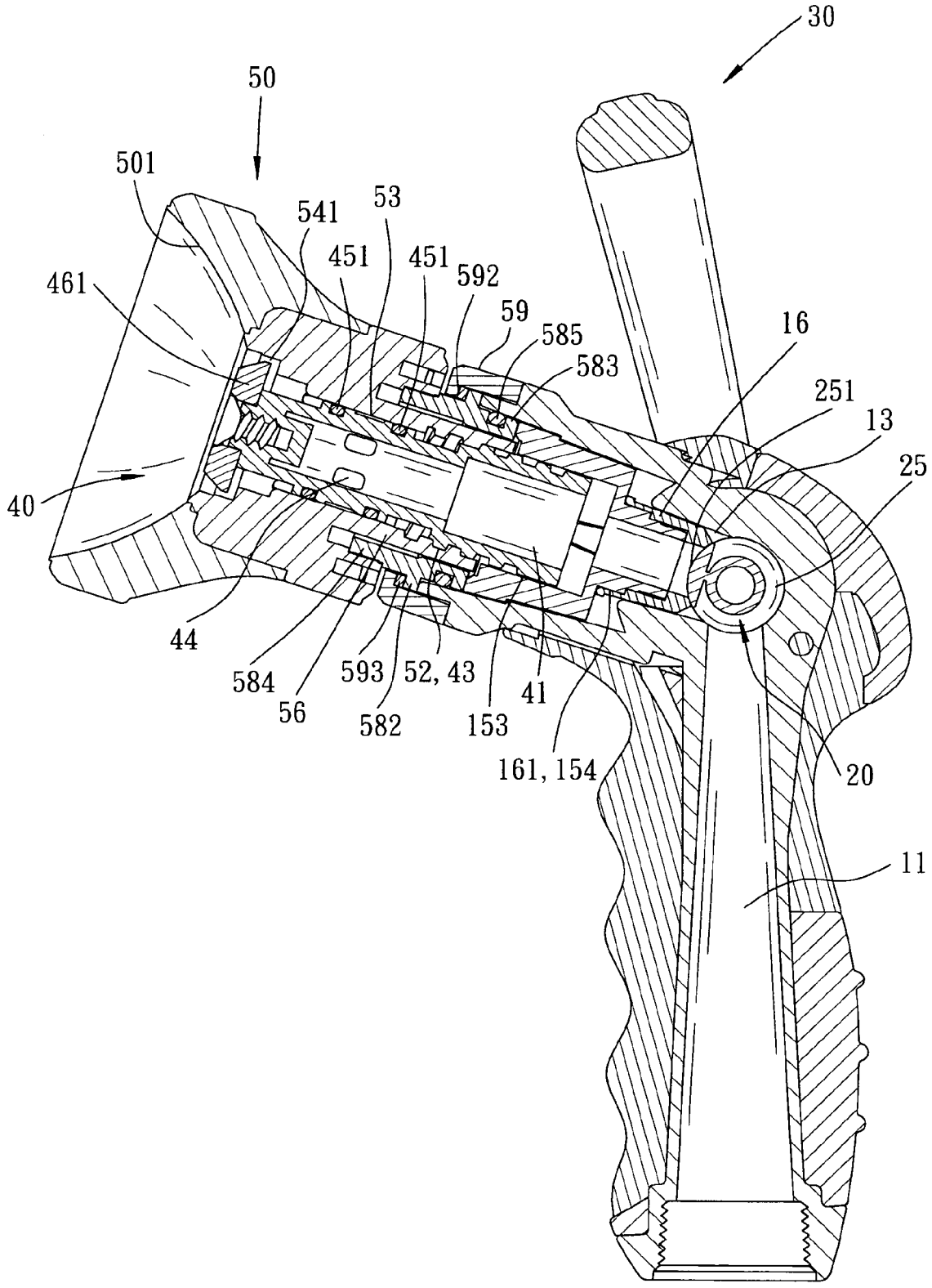
FIG. 6 is an assembled cross sectional view of the present invention in a water shutoff state thereof.
Figure 7:
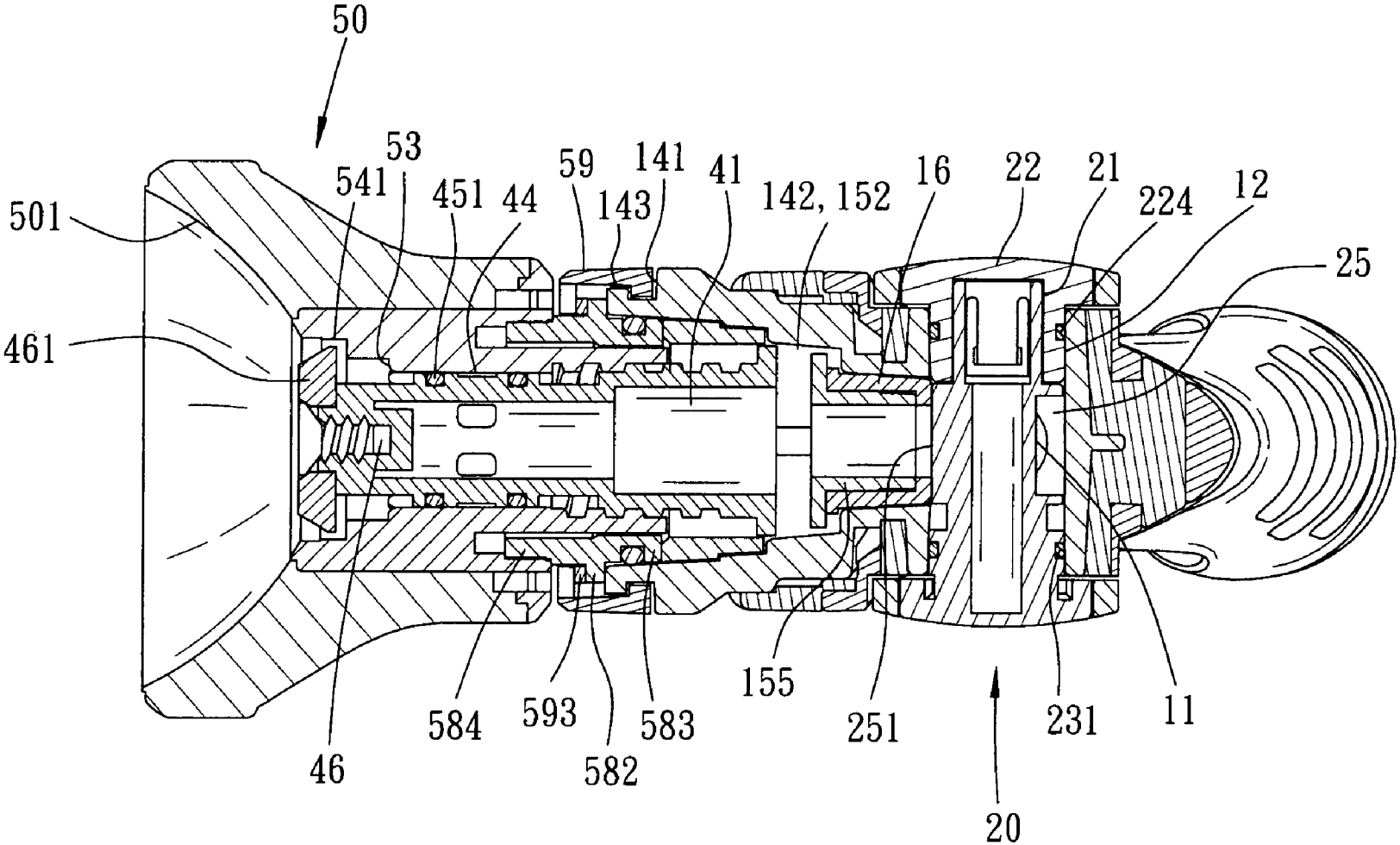
FIG. 7 is another assembled cross sectional view of the present invention in a water shutoff state thereof.
Figure 8:
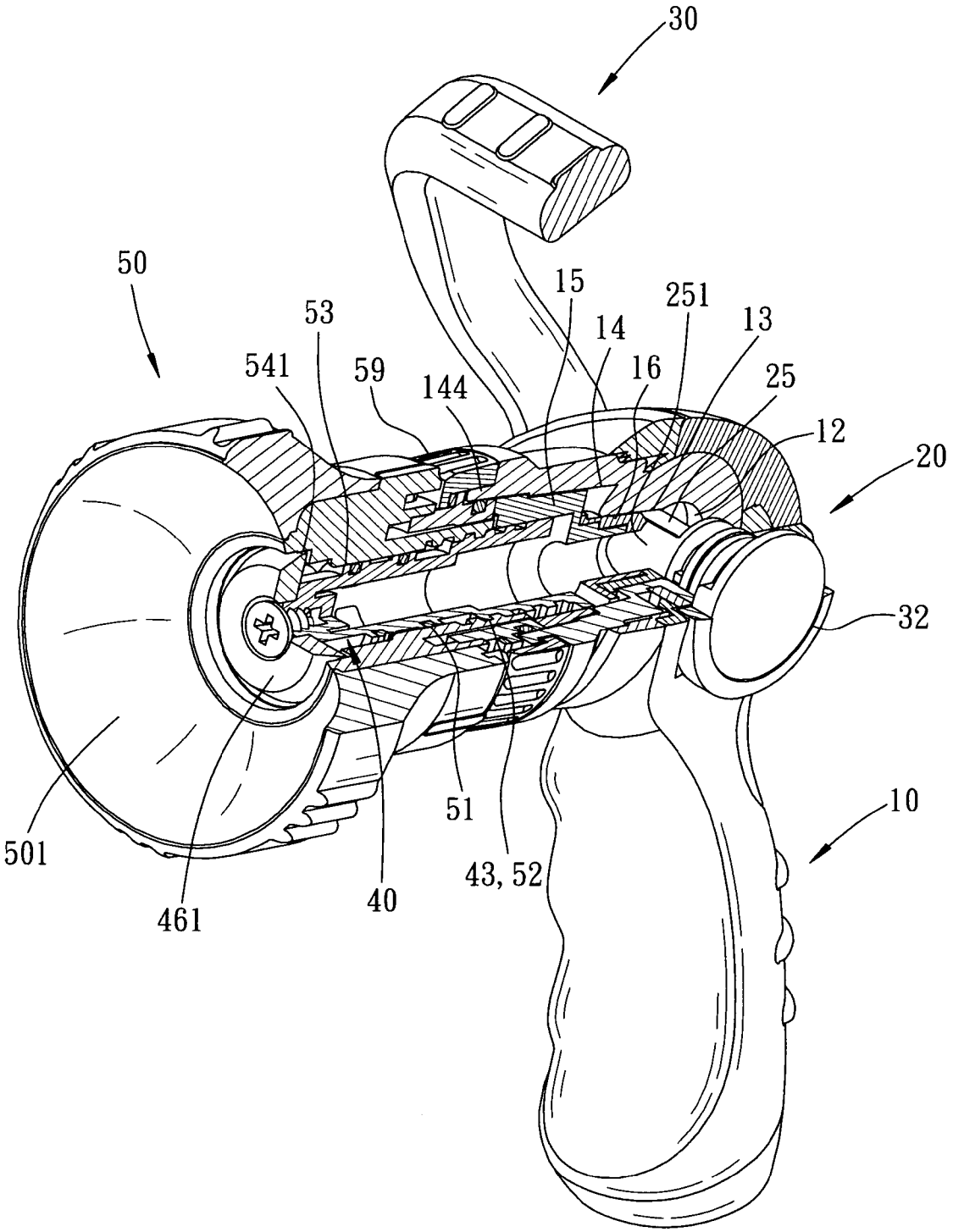
FIG. 8 is an assembled perspective and partially cross sectional view of the present invention.
Figure 9:
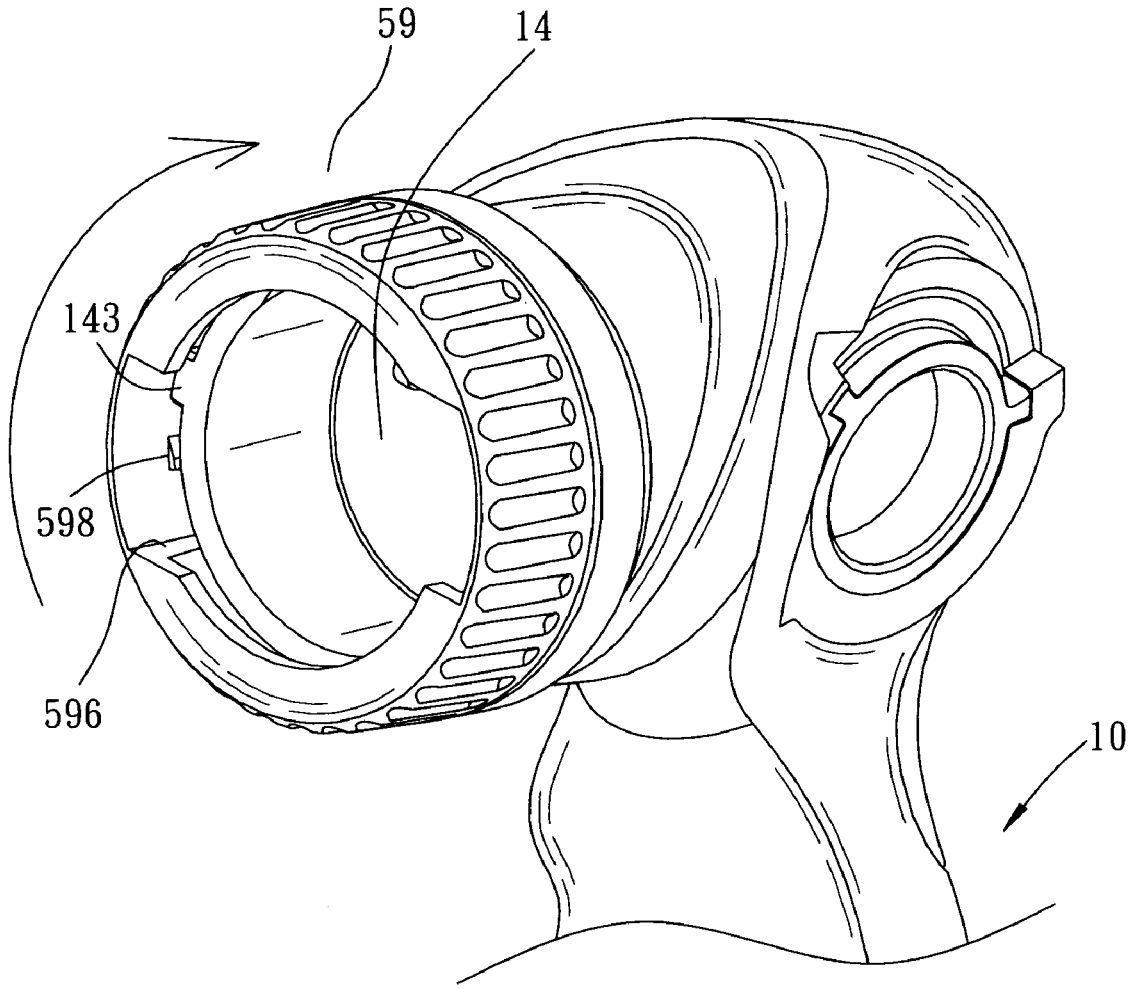
FIG. 9 is a diagram showing the operation of the retrain collar mounted to the body of the present invention.
Figure 10:
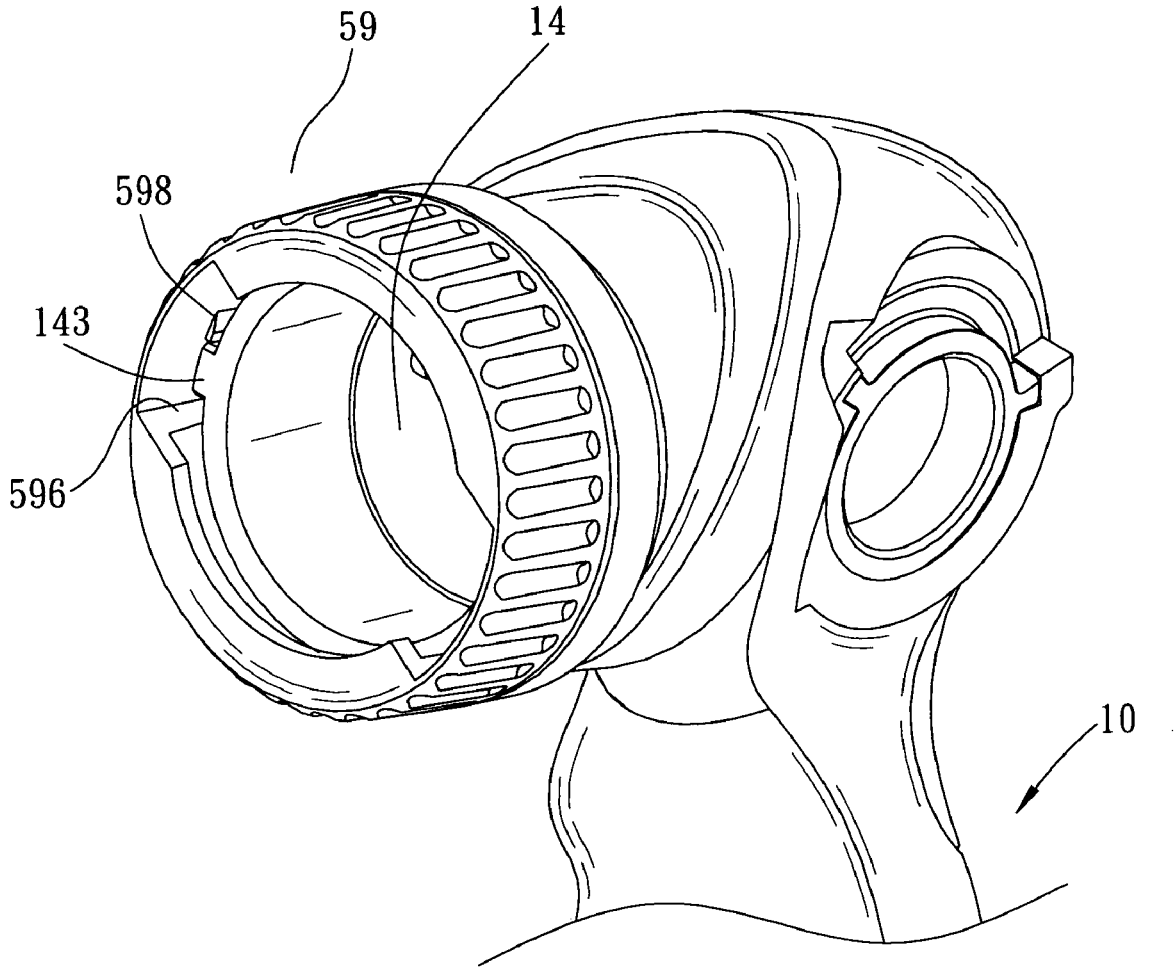
FIG. 10 is a diagram showing protrusions of the body respectively accommodated into restrain zones and restricted in position by restrain blocks of the restrain collar thereof.

Please refer to FIG. 1 showing an exploded perspective view of the present invention (accompanied by FIGS. 2 to 4 inclusive). The present invention relates to a spray gun structure, comprising a body 10, a control valve 20, an adjusting device 30, a water-guiding element 40, and a spray head 50. The body 10 has an inlet duct 11 defined by an internal-threaded section, an assembling chamber 12 transversely extending on top of the inlet duct 11 to fluidly communicate therewith, and a coupling end 14 with a conjoining port 13 therein extending forwards perpendicularly at one side of the assembling chamber 12 for the accommodation of a coupling sleeve 15 thereto. The coupling end 14, molded into a larger diameter, has the internal surface equipped with multiple insert blocks 142 thereon, and the external surface equipped with a connecting section 144 defined by multiple rectangular protrusions 143 thereon to form a stop flange 141 thereby. The assembling chamber 12 thereof has both opening ends each defined by an annularly arcuate positioning space 121. The coupling sleeve 15 has a hollow extending there-through to form a water-influx channel 151 therein, and insert holes 152 and protruding tracks 153 symmetrically arranged in pairs on the internal surface thereon wherein the insert holes 152 are respectively cut to indent into a transverse U-shape at one end surface of the coupling sleeve 15 to fit to each insert block 142 thereby. The coupling sleeve 15 also has one end side equipped with a smaller-diameter coupling section 155 with ribs 154 protruding thereon for the engagement of a soft water-sealing sleeve 16 therewith wherein the soft water-sealing sleeve 16 with a hollow extending there-through has the internal surface defined by a set of symmetrical insert grooves 161, one end edge equipped with a concaved arcuate abutment surface 162, and the outer circumference disposed an arcuate protrusive water-sealing portion 163 thereon. The control valve 20 has one end equipped with a smaller-diameter engaging section 21 to fit to a sealing cap 22, and the other end defined by a ringed groove 23 for the accommodation of a watertight ring 231 thereto and a larger-diameter sealing surface 24 with a set of large and small conjoining blocks 241, 241' protruding thereon to form another engaging section thereby. The control valve 20 also has the middle section symmetrically equipped with a smaller-diameter and semi-spherical indented-surfaced water-influx area 25 and a larger-diameter and semi-spherical protrusive-surfaced water-sealing area 251. The engaging section 21 of the control valve 20 is molded in a tubular shape with the annular circumference symmetrically disposed a set of levelly-cut engaging sides 211 and a set of hooked elastic insert pieces 212. The sealing cap 22 has the internal surface symmetrically disposed a set of levelly-cut engaged sides 221 and a set of through-holes 222 to respectively fit to the engaging sides 211 and the hooked elastic insert pieces 212 thereby. The sealing cap 22 also has the outer periphery defined by an annular groove 223 for the accommodation of a watertight hoop 224 thereto, and at one side of the annular groove 223 thereof is disposed a larger-diameter positioning surface 225 with a set of protrusive bars 226 symmetrically extending at both sides thereon. The adjusting device 30 is equipped with a U-shaped pivotal opening 31 to match to the body 10 thereby and has both end sides each equipped with a stepwise coupling bore 32 to form a positioning seat 33 thereon wherein both coupling bores 32 have the positioning seats 33 respectively equipped with a set of symmetrical cavities 34 to fit to the protrusive bars 226 of the sealing cap 22, and a set of large and small conjoined portions 35, 35' thereon to match to the conjoining blocks 241, 241' of the control valve 20 thereby. And the positioning seat 33 thereof also has a restrictive block 36 protruding at the inner side surface thereon. The water-guiding element 40 has a water-guiding channel 41 extending through the center therein, and one opening end equipped with a restrictive flange 42 with guide recesses 421 cut thereon and a smaller-diameter external-threaded portion 43 extending at one side of the restrictive flange 42 thereof. The water-guiding element 40 also has multiple water-outlet orifices 44 annularly arranged at the outer periphery of the other end to fluidly connect to the water-guiding channel 41 thereby. Both lateral sides of the water-outlet orifices 44 are respectively disposed a ringed groove 45 to which a watertight ring 451 is mounted, and the other end side of the water-guiding element 40 is disposed an indented cavity 46 to which a conically-tapered spray-varying plug 461 is mounted thereby. The spray head 50 is molded into a trumpet-like water-discharging end 501 having a guide port 51 extending through the center thereon. The guide port 51 has one side equipped with an internal-threaded portion 52, and the other side molded into a larger diameter with multiple water-guiding ribs 53 annularly arranged thereon to form multiple water-guiding spaces 54 with a larger-diameter receiving seat 541 extending at one side thereon. A shorter stop surface 55 is spaced out to extend at one side of the guide port 51, permitting the guide port 51 to extend for an appropriate length and form a conjoining end 56 thereby. And a ringed conjoined groove 57 is depressed between the conjoining end 56 and the stop surface 55 to match to a connecting sleeve 58 and a restrain collar 59 thereby. The connecting sleeve 58 has a connecting hole 581 disposed therein and a restrictive seat 582 annularly protruding at the middle section of the outer periphery thereon to divide a set of first and second connecting portions 583, 584 at both end sides thereon wherein the first connecting portion 583 has a round groove 586 defining the outer surface thereon for the accommodation of a water-sealing ring 585 therein. The restrain collar 59, molded into an annular shape to fit to the connecting section 144 of the body 10, has one side equipped with a smaller-diameter opening 591 to form a stop ring 592 to which a slide-guiding pad 593 is matched, and the other side having a set of guide passages 594 symmetrically cut thereon. The guide passages 594 thereof are respectively connected to a resilient area 595 cut at the internal surface of the restrain collar 59 to form an L-shaped restrain zone 596 having a restrain block 598 with an oblique guide surface 597 protruding at an appropriate position thereon to match to the rectangular protrusions 143 of the body 10 thereby.

Please refer to FIGS. 5 to 10 inclusive. In assembly, the pivotal opening 31 of the adjusting device 30 is mounted to one side of the body 10, permitting the coupling bores 32 disposed at both sides thereof to precisely join to both end sides of the assembling chambers 12 and the restrictive blocks 36 thereof to fit into the positioning spaces 121 thereof respectively. The large and small conjoining blocks 241, 241' of the control valve 20 are guided to the conjoined portions 35, 35' of the coupling bore 32 disposed at one side of the adjusting device 30 to mount into the assembling chamber 12 till the sealing surface 24 contacts and abuts against the positioning seat 33, permitting the conjoining blocks 241, 241' to precisely engage with the conjoined portions 35, 35' and locate in place thereto. Then, the water-sealing area 251 and the water-influx area 25 thereof are allowed to precisely locate between the conjoining hole 13 and the inlet duct 11 thereby. And the sealing cap 22 is mounted to the other coupling bore 32 of the adjusting device 30 to precisely couple with the engaging section 21 of the control valve 20 till the elastic insert pieces 212 thereof flexibly hooked to the through-holes 222 thereby. Meanwhile, the engaging sides 211 and the engaged side 221 are precisely fitted to each other and the positioning surface 225 is abutted flat against the other positioning seat 33 of the adjusting device 30, permitting the protrusive bars 226 to precisely insert to the cavities 34 and locate thereto. Besides, the watertight ring 231 of the control valve 20 and the watertight hoop 224 of the sealing cap 22 are utilized to seal up the internal surface of the assembling chamber 12 from both sides so as to prevent water leakage thereby. Then, the insert grooves 161 of the water-sealing sleeve 16 are guided along the ribs 154 of the coupling sleeve 15 to mount to the coupling section 155, and the coupling sleeve 15 is mounted to the coupling end 14 of the body 10 till the insert holes 152 thereof are precisely engaged with the insert blocks 142 and located thereto, permitting the water-sealing portion 163 of the water-sealing sleeve 16 to seal tight onto the internal surface of the conjoining hole 13 thereby. And the abutment surface 162 of the water-sealing sleeve 16 is molded into a concaved arcuate configuration to precisely fit to the curvature of the assembling chamber 12 and abut tight against the water-sealing area 251 so as to form a water shutoff state thereby. Then, the opening 591 of the restrain collar 59 is led through the conjoining end 56 of the spray head 50 to abut against the stop surface 55 before the connecting hole 581 of the connecting sleeve 58 is guided to the conjoining end 56 thereof till the second connecting portion 584 thereof is mounted to the conjoined groove 57 and fastening-bonded thereto via ultrasonic-wave operation thereby. Thus, the stop ring 592 of the restrain collar 59 limited in position by the restrictive seat 582 and the stop surface 55 can rotate freely therein, and the slide-guiding pad 593 is precisely accommodated between the stop ring 592 and the restrictive seat 582 thereof. The water-guiding element 40 is then mounted to the guide port 51 of the spray head 50 till the external-threaded section 43 thereof is secured to the internal-threaded portion 52 thereof, permitting the watertight rings 451 disposed at both sides of the water-outlet orifices 44 to respectively seal to the internal surface of the guide port 51 and the water-guiding ribs 53 thereby. Then, the indented cavity 46 of the water-guiding element 40 is precisely matched to the water-discharge end 501 before engaged with the spray-varying plug 461, permitting the plug 461 to accommodate into the receiving seat 541 thereby. The guide recesses 421 of the water-guiding element 40 are led to the coupling end 14 of the body 10 till engaged with the protruding tracks 153 and positioned thereto, and the first connecting portion 583 of the connecting sleeve 58 is precisely joined to the coupling end 14 to press against the end edge of the coupling sleeve 15 thereby. Thus, the abutment surface 162 and the water-sealing ring 585 are respectively sealed tight onto the water-sealing area 251 and the internal surface of the coupling end 14 thereof so as to achieve leaking-proof effect thereby. Finally, the guide passages 594 of the restrain collar 59 are guided along the protrusions 143 of the connecting section 144 thereof to abut against the stop flange 141, and the resilient areas 595 of the restrain collar 59 are pressed by force so that the restrain collar 59 deformed thereby can be rotated in movement. Then, the protrusions 143 thereof can be respectively slid along the oblique guide surfaces 597 of the restrain collar 59 and glided to the other side of the restrain blocks 598 so as to be restricted in position at the restrain zones 596 therein, completing the assembly of a spray gun thereby.

Figure 11:
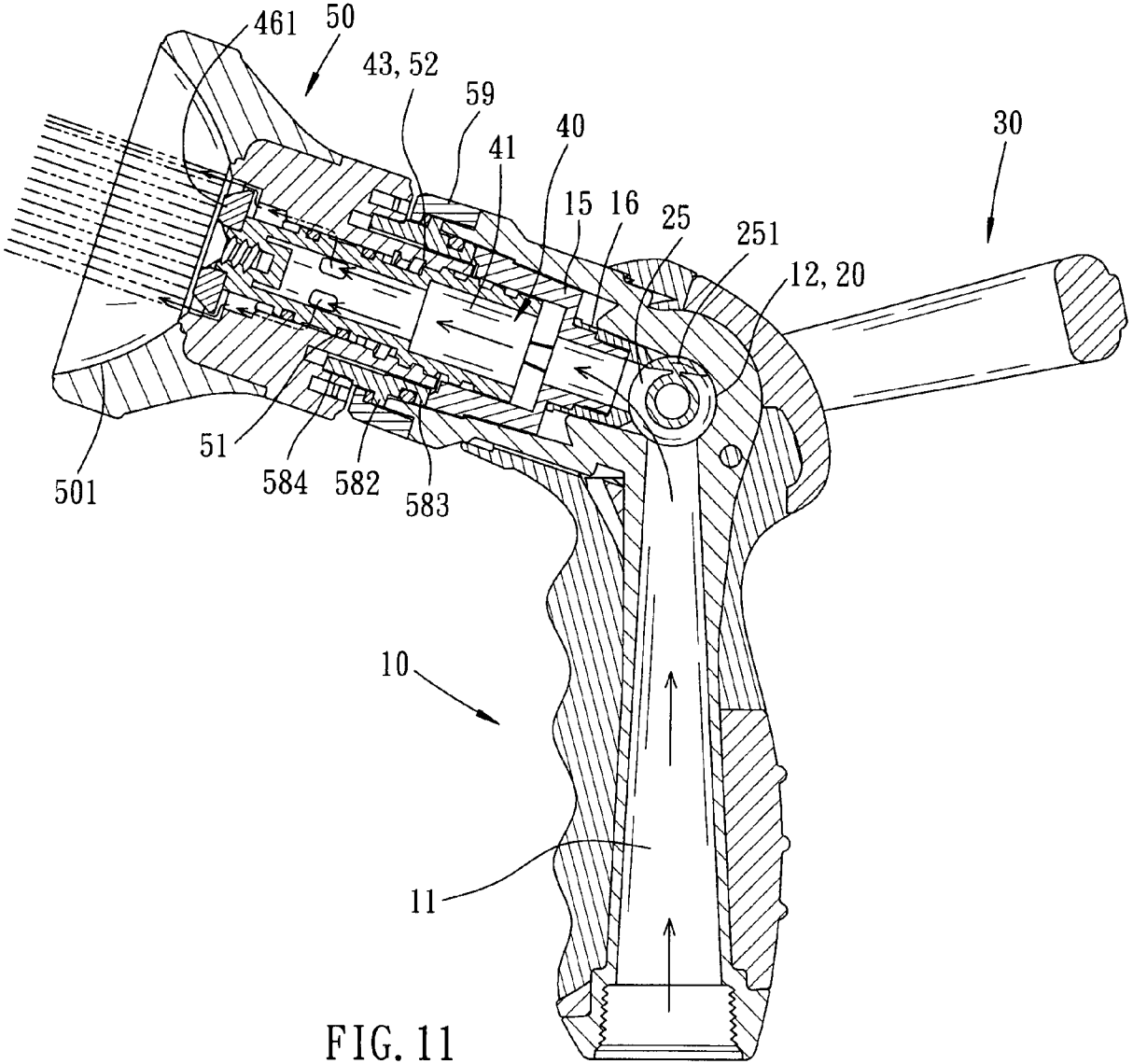
FIG. 11 is a diagram showing a water-influx area of the control valve switched by an adjusting device to match to a conjoining hole of the body, and a plug of the water-guiding element accommodated into a receiving seat of a spray head, permitting water discharge to be ejected outward in a column-like spray pattern.
Figure 12:
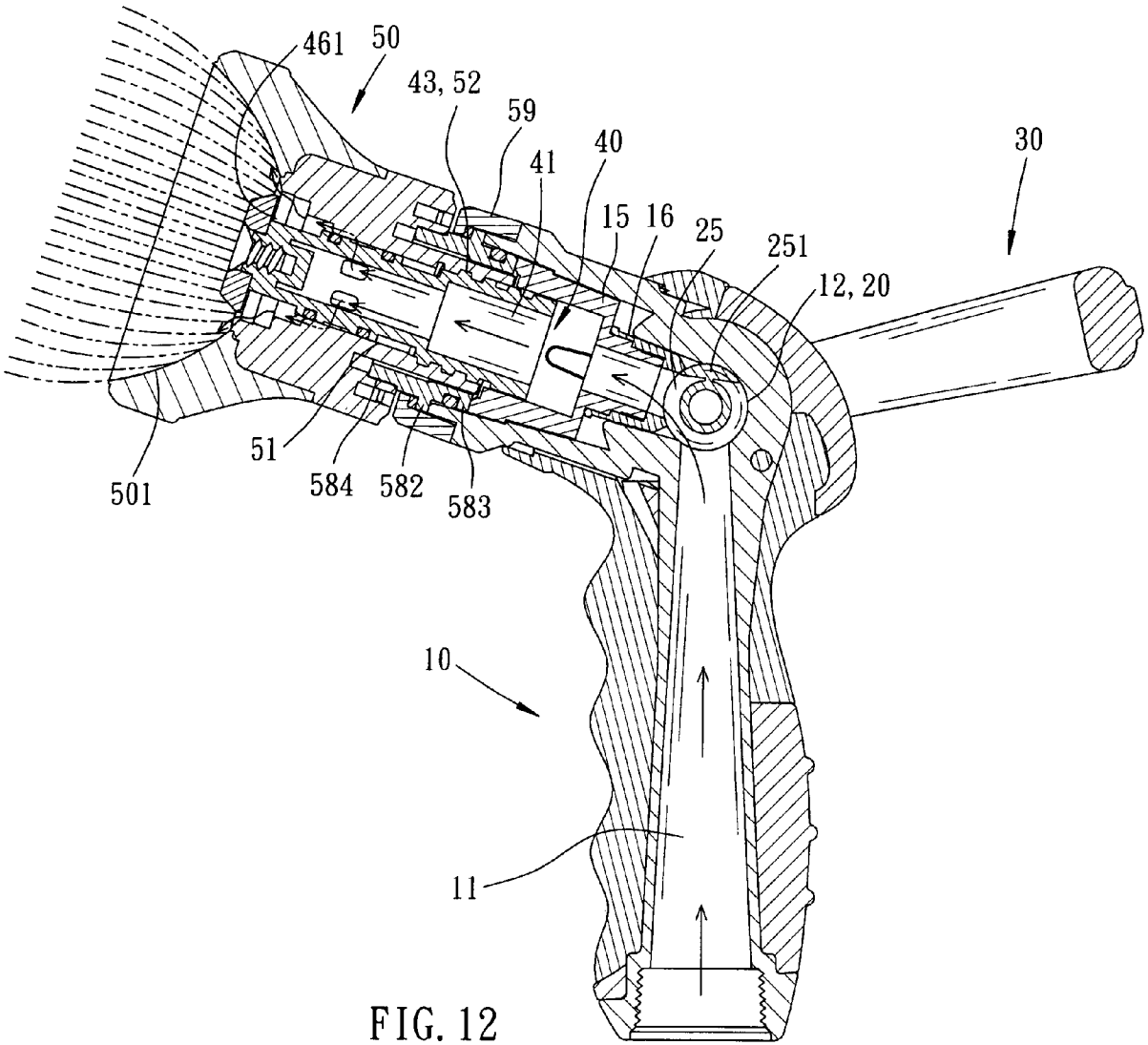
FIG. 12 is a diagram showing the water-influx area of the control valve switched by the adjusting device to match to the conjoining hole of the body, and the plug of the water-guiding element extending outside the receiving seat of the spray head, permitting water discharge to be sprinkled outwards in a radial-spreading spray pattern.

Please refer to FIG. 11. In application, the conjoining blocks 241, 241' of the control valve 20 and the protrusive bars 226 of the sealing cap 22 are utilized to respectively engage with the conjoined portions 35, 35' and the cavities 34 disposed at both sides of the adjusting device 30, forming an interlinking mechanism thereby. Therefore, the restrictive blocks 36 of the adjusting device 30 are simply rotated to one side and slid along the positioning spaces 121 therein, synchronically actuating therewith the water-sealing area 251 of the control valve 20 pivotally rotating along the assembling chamber 12 therein. Meanwhile, the abutment surface 162 of the water-sealing sleeve 16 is utilized to abut tight against the water-sealing area 251, and the watertight ring 231 and the watertight hoop 224 mounted at both sides of the control valve 20 are applied to seal up the internal surface of the assembling chamber 12 from both sides, forming an enclosed water-inlet chamber to achieve leaking-proof purpose thereby. Besides, the control valve 20 in rotation is reduced in the friction area with the assembling chamber 12 and the water-sealing sleeve 16, permitting smooth and effortless rotation of the adjusting device 30 thereby. The water-sealing area 251 can be slid along with the rotation of the adjusting device 30 to detach from the abutment surface 162 till the water-influx area 25 extending at both sides thereof is switched to fluidly connect to the inlet duct 11 and the water-guiding channel 41 and form a water-discharging state thereby. Then, water will flow through the inlet duct 11 to enter the water-influx area 25 and the water-guiding channel 41 in a sequence before flushing outwards via each water-outlet orifice 44 thereof. The water coming out via the water-outlet orifices 44 will get blocked by the watertight rings 451 mounted at both sides thereof to flow along each water-guiding rib 53 and pass through the water-guiding spaces 54 to be emitted outwards through the spray-varying plug 461. Besides, the connecting sleeve 58 and the spray head are fixedly engaged with each other to restrict the position of the restrain collar 59 that is also limited by the connecting section 144 of the body 10. Therefore, the spray head 50 can synchronically actuate the restrictive seat 582 and the water-sealing ring 585 of the connecting sleeve 58 to respectively rotate along the slide-guiding pad 593 and the internal surface of the connecting section 144 thereby. Meanwhile, the guide recesses 421 of the water-guiding element 40 are fitted to the protruding tracks 153 of the coupling sleeve 15 so that, when the guide port 51 keeps rotating, the external-threaded portion 43 of the water-guiding element 40 will move linearly forwards or backwards along the protruding tracks 153 so as to adjust the pattern of water spray thereby. When the water-guiding element 40 is actuated by the rotation of the spray head 50 to recede backwards till the spray-varying plug 461 is accommodated into the receiving seat 541, water flow is allowed to flush between the plug 461 and the receiving seat 541 to directly discharge outwards in the pattern of a column-like spray. When the water-guiding element 40 is actuated by the rotation of the spray head 50 to move forwards till the spray-varying plug 461 is detached from the receiving seat 541, the water flow will be blocked by the plug 461 to hit the trumpet-like surface of the water-discharging end 501 thereof and emit outwards in the pattern of a radial-spreading spray as shown in FIG. 12.

Figure 13:
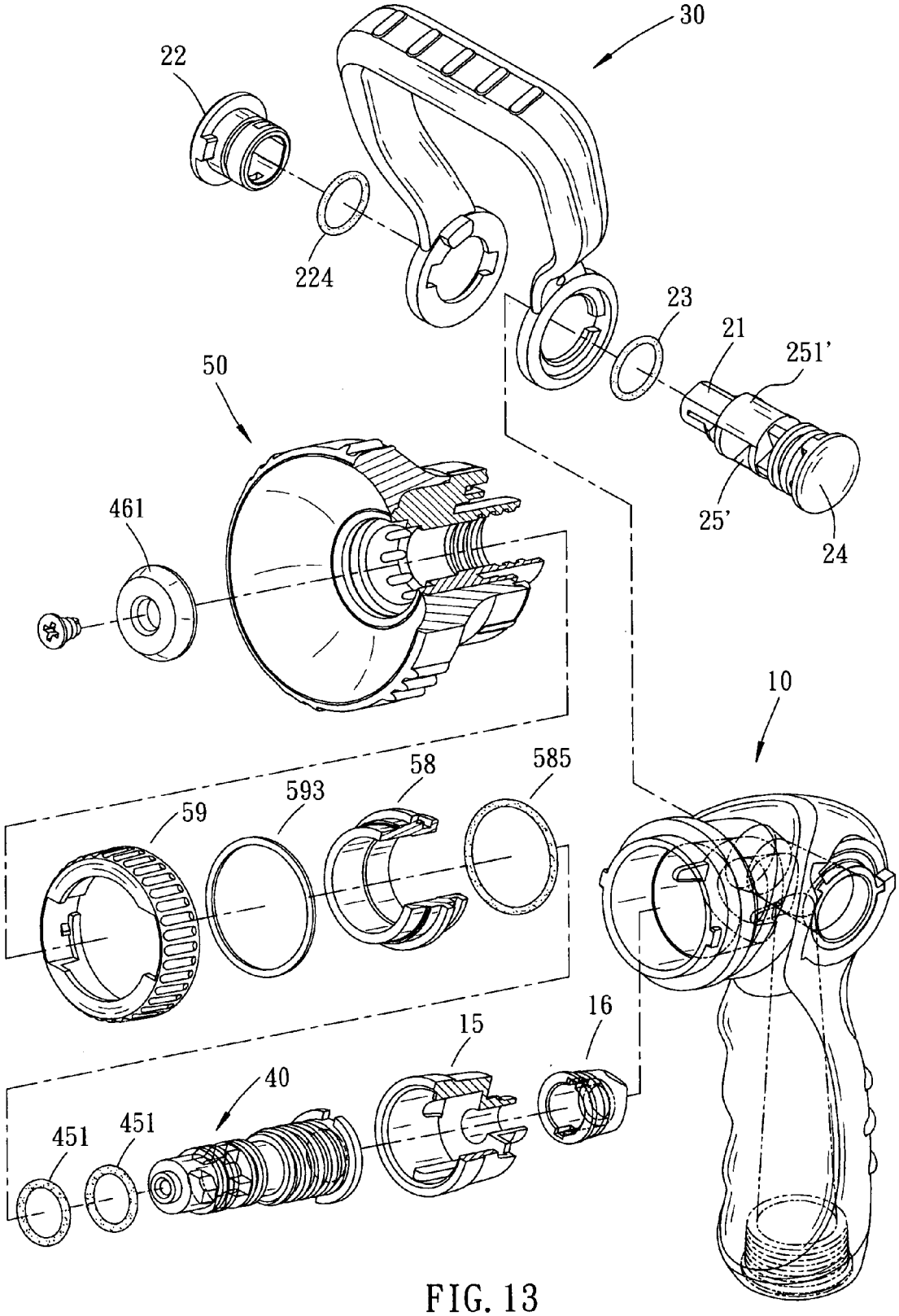
FIG. 13 is an exploded perspective view of another embodiment of the present invention.

Please refer to FIG. 13. The control valve 20 can also have a water-influx area 25' disposed in the middle section and a set of water-sealing areas 251' symmetrically extending at both sides of the water-influx area 25' wherein the water-sealing areas 251' are respectively molded into the shape of an arcuate plate.

What is claimed is:

1. A spray gun structure, comprising a body equipped with an inlet duct and an assembling chamber extending on top of the inlet duct for the accommodation of a control valve therein wherein the control valve is equipped with water-sealing and water-influx areas and is synchronically actuated by an adjusting device to switch on/off water discharge thereby; besides, the body also includes a coupling end with a conjoining port therein extending forwards perpendicularly at one side of the assembling chamber for the accommodation of a coupling sleeve having a water-influx channel defining therein and a soft water-sealing sleeve mounted thereto; the water-sealing sleeve has one end defined by a concaved arcuate abutment surface to seal tight onto the protrusive arcuate surface of the water-sealing area of the control valve; the coupling sleeve also has protruding tracks extending at the internal surface thereon to fit to guide recesses of a water-guiding element equipped with an external-threaded portion thereon; the coupling end of the body thereof also has the external periphery equipped with a connecting section with protrusions extending thereon to match to a spray head thereby; the spray head has a central guide port with an internal-threaded portion extending at one side to secure to the external-threaded portion of the water-guiding element thereby; the water-guiding element has a water-guiding channel extending through the center therein and multiple water-outlet orifices annularly arranged at the outer periphery of one end to fluidly connect to the water-guiding channel for the transport of water flow thereby wherein both end sides of the water-outlet orifices thereof are respectively disposed a ringed groove for the accommodation of a watertight ring thereto so as to seal tight onto the internal surface of the guide port of the spray head thereby; the guide port of the spray head has one side equipped with water-guiding spaces with a larger-diameter receiving seat extending thereon to fit to a spray-varying plug mounted to the top end of the water-guiding element thereof; the guide port of the spray head also has the other side equipped with a conjoining end to which a water-sealing ring is mounted and a restrain collar is guided thereto; besides, the conjoining end of the spray head thereof is accommodated into the coupling end of the body to abut against the end edge of the coupling sleeve thereby, permitting the water-sealing ring to seal tight onto the internal surface of the coupling end thereof; the restrain collar has the internal surface symmetrically depressed with a set of resilient areas each equipped with a guide passage to form a restrain zone thereby wherein the restrain zones are respectively equipped with a restrain block defined by an oblique guide surface thereon to match to the protrusions of the body thereby; whereby, when the spray head is pivotally rotated to and forth in its own place, the water-guiding element can be synchronically actuated to move linearly forwards or backwards so as to adjust the location of the spray-varying plug and change the pattern of water spray thereby.

2. The spray gun structure as claimed in claim 1 wherein the coupling sleeve has a smaller-diameter coupling section extending at one side thereon for the engagement of the soft water-sealing sleeve therewith, and the soft water-sealing sleeve has a hollow extending there-through to precisely fit tight into the conjoining hole of the body thereby.

3. The spray gun structure as claimed in claim 1 wherein the spray head has a shorter stop surface spaced out at one side of the guide port, permitting the conjoining end to extend outwards for an appropriate length, and a conjoined groove is depressed between the conjoining end and the stop surface to match to the restrain collar and a connecting sleeve thereby; the restrain collar is equipped with a stop ring to precisely abut against the stop surface of the spray head, and has a smaller-diameter opening disposed thereon; the connecting sleeve has a connecting hole disposed therein to mount to the conjoining end of the spray head thereby, and a restrictive seat annularly protruding at the middle section of the outer periphery thereon to divide a set of first and second connecting portions at both sides thereon wherein the first connecting portion, having a round groove defining the outer surface thereon for the accommodation of a water-sealing ring therein, is precisely fitted into the coupling end of the body and pressed against the end edge of the coupling sleeve thereby; besides, the connecting hole of the connecting sleeve is mounted to the conjoining end of the spray head till the second connecting portion thereof is accommodated and fixed into the conjoined groove of the spray head thereby, permitting the stop ring of the restrain collar to be restricted in position by the restrictive seat of the connecting sleeve and the stop surface of the spray head thereby; furthermore, the guide passages of the restrain collar can be guided along the protrusions of the body to abut against the stop flange of the connecting section of the body thereof; whereby, the resilient areas of the restrain collar can be pressed by force so that the restrain collar deformed thereby can be rotated till the protrusions thereof are respectively slid along the oblique guide surfaces of the restrain blocks and glided to the other side of the restrain blocks to be restricted in position at the restrain zones therein.

4. The spray gun structure as claimed in claim 1 wherein the water-guiding element has one opening end equipped with a restrictive flange to be mounted into the coupling sleeve, and guide recesses are symmetrically cut at the outer periphery of the restrictive flange thereon to respectively fit into the protruding tracks of the coupling sleeve for location thereby.

5. The spray gun structure as claimed in claim 1 wherein the restrain blocks of the restrain collar are respectively equipped with an oblique guide surface cut thereon.

6. The spray gun structure as claimed in claim 1 wherein a slide-guiding pad is mounted between the stop ring of the restrain collar and the restrictive seat of the connecting sleeve and located there-between.

7. The spray gun structure as claimed in claim 1 wherein the protrusions of the body thereof are respectively molded into a rectangular shape.

8. The spray gun structure as claimed in claim 1 wherein the assembling chamber of the body has both opening ends each defined by an annularly arcuate positioning space thereon.

9. The spray gun structure as claimed in claim 1 wherein the control valve has one end equipped with a smaller-diameter engaging section to fit to a sealing cap, and the other end defined by a ringed groove for the accommodation of a water-tight ring thereto and a larger-diameter sealing surface with a set of large and small conjoining blocks protruding thereon to form another fixing section thereby; the engaging section of the control valve is molded in a tubular shape with the annular circumference symmetrically defined by a set of levelly-cut engaging sides and a set of hooked elastic insert pieces; the sealing cap has the internal surface symmetrically defined by a set of levelly-cut engaged sides and a set of through-holes to respectively fit to the engaging sides and the hooked elastic insert pieces of the control valve thereby; the sealing cap also has the outer periphery defined by an annular groove for the accommodation of a watertight hoop thereto, and at one side of the annular groove thereof is disposed a larger-diameter positioning surface with a set of protrusive bars symmetrically extending at both sides thereon; the adjusting device is equipped with a U-shaped pivotal opening to match to the body thereby and has both end sides each equipped with a stepwise coupling bore to form a positioning seat thereon wherein both coupling bores have the positioning seats respectively equipped with a set of symmetrical cavities to fit to the protrusive bars of the sealing cap, and a set of large and small conjoined portions thereon to match to the conjoining blocks of the control valve thereby; the positioning seats of the adjusting device are respectively equipped with a restrictive block protruding at the inner side surface thereon to fit into the annularly arcuate positioning space indented at both lateral opening ends of the assembling chamber of the body thereof.

10. The spray gun structure as claimed in claim 1 wherein the water-influx area and the water-sealing area of the control valve are symmetrically disposed at the control valve thereon; the water-flux area is defined by a smaller-diameter and semi-spherical indented surface, while the water-sealing area is molded into a larger-diameter and semi-spherical protrusive surface thereof.

11. The spray gun structure as claimed in claim 1 wherein the control valve can also have a water-influx area disposed in the middle section with a set of water-sealing areas symmetrically extending at both sides of the water-influx area thereon, and the water-sealing areas are respectively molded into the shape of an arcuate plate.

12. The spray gun structure as claimed in claim 1 wherein the coupling end of the body has the internal surface equipped with multiple insert blocks thereon to fit to insert holes arranged at the internal surface of the coupling sleeve and locate thereto; the insert holes are respectively cut to indent into a transverse U-shape at one end surface of the coupling sleeve to fit to each insert block thereby.

13. The spray gun structure as claimed in claim 1 wherein the coupling section of the coupling sleeve and the soft water-sealing sleeve are respectively equipped with ribs and insert grooves that are reciprocally engaged with each other and located thereby.

14. The spray gun structure as claimed in claim 1 wherein the water-sealing sleeve has the outer circumference disposed an arcuate protrusive water-sealing portion to seal tight onto the internal surface of the conjoining hole of the body thereby.

15. The spray gun structure as claimed in claim 1 wherein the water-guiding spaces of the spray head are defined by multiple water-guiding ribs annularly arranged at the internal surface thereon.

* * * * *